US008181410B2

(12) United States Patent
Stensrud

(10) Patent No.: US 8,181,410 B2
(45) Date of Patent: May 22, 2012

(54) INSULATION SYSTEM AND METHOD FOR PRE-ENGINEERED BUILDINGS

(75) Inventor: Michael D. Stensrud, Saskatoon (CA)

(73) Assignee: Armand Holdings, Ltd., Saskatoon (CA)

( * ) Notice: Subject to any disclaimer, the term of this patent is extended or adjusted under 35 U.S.C. 154(b) by 324 days.

(21) Appl. No.: 12/336,082

(22) Filed: Dec. 16, 2008

(65) Prior Publication Data

US 2009/0151286 A1 Jun. 18, 2009

Related U.S. Application Data

(60) Provisional application No. 61/014,333, filed on Dec. 17, 2007.

(51) Int. Cl.
*E04B 1/74* (2006.01)
*E04B 5/00* (2006.01)
*E04B 1/00* (2006.01)

(52) U.S. Cl. ..... 52/407.3; 52/742.12; 52/404.1; 52/408; 52/411

(58) Field of Classification Search ..... 52/407.3, 52/404.3, 742.1, 272, 404.1, 408, 409, 410, 52/411, 650.3
See application file for complete search history.

(56) References Cited

U.S. PATENT DOCUMENTS

| | | | | |
|---|---|---|---|---|
| 3,307,306 | A * | 3/1967 | Oliver | 52/409 |
| 4,233,791 | A * | 11/1980 | Kuhl et al. | 52/309.1 |
| 4,310,992 | A | 1/1982 | Thabet | |
| 4,346,543 | A | 8/1982 | Wilson et al. | |
| 4,573,298 | A * | 3/1986 | Harkins | 52/404.3 |
| 4,616,453 | A * | 10/1986 | Sheppard et al. | 52/93.1 |
| 4,635,423 | A * | 1/1987 | Ward | 52/746.1 |
| 4,651,489 | A * | 3/1987 | Hodges et al. | 52/409 |
| 7,127,858 | B2 * | 10/2006 | Layfield | 52/407.1 |
| 7,754,304 | B1 * | 7/2010 | Hohmann, Jr. | 428/40.1 |
| 2004/0123539 | A1 * | 7/2004 | Fay et al. | 52/407.3 |

* cited by examiner

*Primary Examiner* — Eileen D Lillis
*Assistant Examiner* — Ryan Kwiecinski
(74) *Attorney, Agent, or Firm* — Greenlee Sullivan P.C.

(57) ABSTRACT

A metal building insulation system and method for by-pass wall girt metal building systems which facilitates the installation of wall insulation applied from the interior of the building for the full depth of the wall girt. Integrally faced vapor barrier blanket insulation combined with vapor barrier extensions installed behind perimeter structural and corner columns before wall girt erection are preferred system components.

13 Claims, 7 Drawing Sheets

INSULATION SYSTEM AND METHOD FOR PRE-ENGINEERED BUILDINGS

CROSS-REFERENCE TO RELATED APPLICATION

This application claims priority from U.S. Provisional Patent Application No. 61/014,333 filed Dec. 17, 2007, which is incorporated by reference herein to the extent that there is no inconsistency with the present disclosure.

FIELD OF THE INVENTION

This invention relates to systems, methods and components for insulating pre-engineered steel buildings.

BACKGROUND OF THE INVENTION

The construction of metal building systems, often referred to as "pre-engineered" metal buildings systems, includes building systems comprised of metal structural members (structural wall columns, corner columns and roof support members) with horizontal metal wall girts and metal roof purlins covered by integrally faced/laminated vapor barrier fiberglass blanket insulation and exterior metal cladding. The majority of these metal building systems incorporate what is commonly known as a by-pass wall girt design, in which the building support perimeter columns and main roof support members are installed followed by horizontal, parallel spaced wall girts installations which are bolted exterior to the columns and thus by-pass, and often lap over, the exterior column locations. At the roof, the main roof support members (sometimes termed rafters or rake beams) have parallel spaced roof purlins attached above the roof support members, oriented normal to the direction of the roof support members. A typical prior art steel structural frame of this nature is shown in FIG. 1, in which the perimeter column and main roof support members are shown as I-beams, and the wall girts and roof purlins are shown as generally Z-shaped metal channel members. FIG. 1 also shows a typical prior art eave purlin at the roof side wall edge and a building base C-channel at the wall base. This building system is generally used by many of the commercial manufacturers of pre-engineered building systems, including Butler, Robertson, Ceco, Varco Prudin and American.

In these prior art systems, following the installation of the above-described steel structural framework, the horizontal wall girts are covered by firstly positioning in vertical orientation, suspended from the eave, integrally faced/laminated vapor barrier fiberglass blanket. This blanket insulation is installed exterior to the wall girts and roof purlins, with the vapor barrier facing inwardly, as can be seen in FIG. 1. The exterior metal cladding, such as sheet metal, is then installed over the blanket insulation. The metal cladding is then mechanically secured in place by drilling through the metal cladding, through the blanket insulation and the interior vapor barrier facing into the wall girts. The fasteners are screws with compressive washers. The screws are tightened sufficiently to compress the washers to prevent the ingress of moisture through the screw holes. The roof is similarly insulated by installing the interior faced blanket insulation above the roof purlins prior to applying the exterior metal cladding. The cladding is secured by drilling through the cladding and insulation and mechanically securing to the roof purlins with similar screw fasteners and compressive washers.

The tightening of the screws causes compression of the laminated vapor barrier insulation material between the cladding and wall girts, and between the cladding and roof purlins. This compression substantially reduces the heat insulating properties of the blanket insulation along each attachment line. For instance, a 6 inch R20 insulation can drop to only about R10 or R12 due to these compression points. One prior art approach to address the problem of compression of the insulation at the wall girts is shown in U.S. Pat. No. 4,346,543 issued Aug. 31, 1982 to Wilson et al. This patent describes the use of higher compressive strength insulation between the wall girt and the exterior metal cladding. U-channel members are also used exterior of the wall girts to hold the blanket insulation without compression. However, the patent still relies on exterior installation of the blanket insulation, which has the problems mentioned below.

In the past, the maximum thickness and corresponding RSI value of the wall insulation applied in blanket form has been functionally limited to 6 inches due to a number of factors, including:

a) the difficulty in compressing heavier insulations without significant deformation of the metal cladding; and b) the weight of heavier insulation becoming difficult to manually support.

The prior art insulation systems are additionally problematic when the insulation must be installed in poor weather conditions, particularly during windy or rainy conditions. Since the insulation is installed prior to closing in the building with the exterior metal cladding, the insulation and workers are exposed to the environmental elements. The blanket insulation can act similar to a sail catching wind, which causes the significant delays during erection. During periods of significant rainfall the exposed insulation becomes saturated with moisture damaging the insulation and thermal effectiveness.

As well, the prior art building installation and insulation methods leave the horizontal wall girts exposed on the interior of the building space. Being horizontal the exposed girts become home for dust and debris creating a home for interior environmental contaminants and refuge for dust mites and vermin.

There is a need for an improved insulation method and system which facilitates the following:

a) installation of blanket insulation from the interior of the building space, into the building framework, in a generally uncompressed form, for the full depth of the horizontal wall girt to maximize the thermal effectiveness of the wall insulation system;

b) increased building erection efficiencies by incorporating a system less prone to weather delays or damage; and c) reducing the exposed horizontal wall girt condition on the interior of the building space.

SUMMARY OF THE INVENTION

The invention provides a method of insulating a building framework for a by-pass wall girt metal building type. This building framework includes vertical structural wall columns, corner columns and roof structural members to support side walls, end walls and a roof, the wall and corner columns having exterior faces, the building framework further including parallel spaced horizontal wall girts connected to the exterior faces of the structural and corner columns, and parallel spaced roof purlins connected above and normal to the roof structural members. In the method of the invention, prior to connecting the wall girts, a vapor barrier extension member formed of vapor barrier material is connected to the exterior faces of the wall and corner columns. The vapor barrier extension member is formed with lap extensions which extend horizontally in both directions beyond the exterior face or faces of the wall and corner columns to connect to the interior facing of the later to be installed insulation. The wall girts are then connected to the exterior faces of the wall and corner columns, and insulation is installed between the wall girts. The insulation may be installed in one or more layers, with the innermost layer being formed with an interior facing, such as a layer of laminated vapor barrier. The lap extensions of the vapor barrier extensions are fastened to the interior facing of the insulation on either side of the wall and corner columns. This method allows insulation to fill the full depth of the wall girt cavity and avoids compression of the insulation when fastening the exterior cladding.

The method preferably includes installing the exterior cladding exterior to the wall girts, prior to the installing the insulation. This avoids the above-noted problems of installing insulation in poor weather conditions. The insulation is preferably a blanket of insulation material laminated to the interior facing, and the insulation is installed horizontally above and below the wall girts from the interior of the building. Insulation may be installed in multiple layers with a back layer of unfaced insulation material and the innermost layer being integrally faced/laminated vapor barrier blanket insulation.

In a preferred embodiment, the interior faced blanket insulation is formed with facing flaps at the side edges of the roll, the facing flaps being sections of the vapor barrier material with are not laminated to the insulation material. These facing flaps allow for sealing together of adjacent insulation sections above and below the wall girts to form horizontal lap seals which overlie the wall girt.

The invention further extends to a building insulation system comprising the vapor barrier extensions and the interior faced insulation. Additional components of the system may include tape, adhesive, C-channel members to assist in sealing the insulation at the top of the building, metal fasteners for the C-channel members, pressure strips of gauge metal and metal fasteners to connect over the horizontal lap seals at the wall girts, and thermal breaks configured to connect to the exterior face of the wall girts. The invention also extends to individual components of the building system.

DESCRIPTION OF THE PREFERRED EMBODIMENTS

As used herein and in the claims, the word "comprising" is used in its non-limiting sense to mean that items following the word in the sentence are included and that items not specifically mentioned are not excluded. The use of the indefinite article "a" in the claims before an element means that one of the elements is specified, but does not specifically exclude others of the elements being present, unless the context clearly requires that there be one and only one of the elements.

As used herein and in the claims, the terms "side", "end", "vertical", "horizontal", "upper", "lower", "top" and "bottom", and other like terms indicating relative positions above or below or to the side of a given point or element, are used in this description or figures to more clearly describe some embodiments of the invention. However, when applied to systems and methods for insulating pre-engineered buildings, such terms may refer to another relationship as appropriate. The term "exterior" is used herein and in the claims to mean exterior-facing when installed, while the term "interior" is used herein and in the claims to mean interior-facing when installed.

Figure 1:
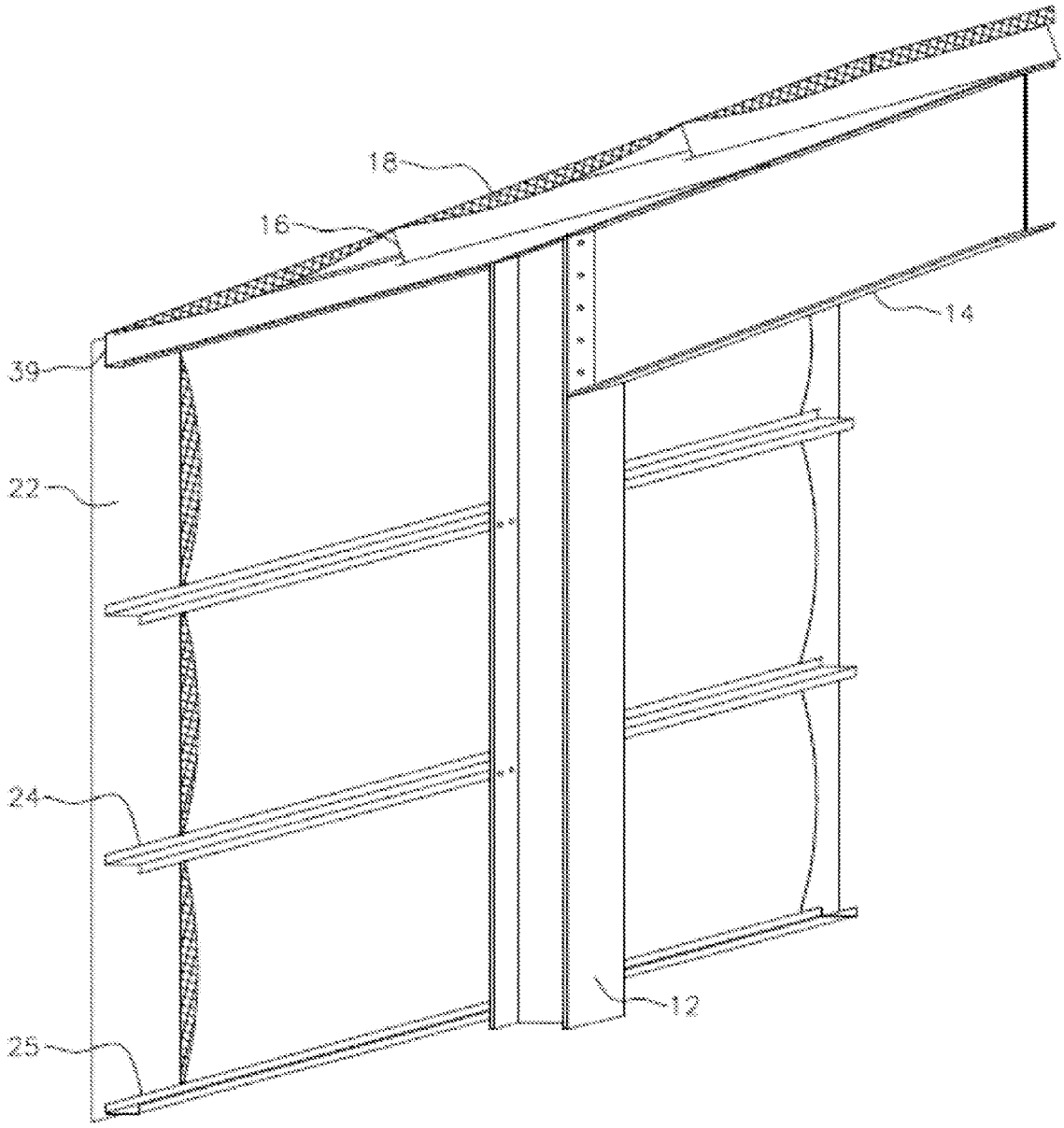
Figure 1 Prior Art
FIG. 1 is a side perspective view of a side wall and roof section of a prior art insulation system for pre-engineered buildings showing blanket insulation installed exterior to the wall girts, resulting in the undesired compression of the insulation at the fastening points.
Figure 2:
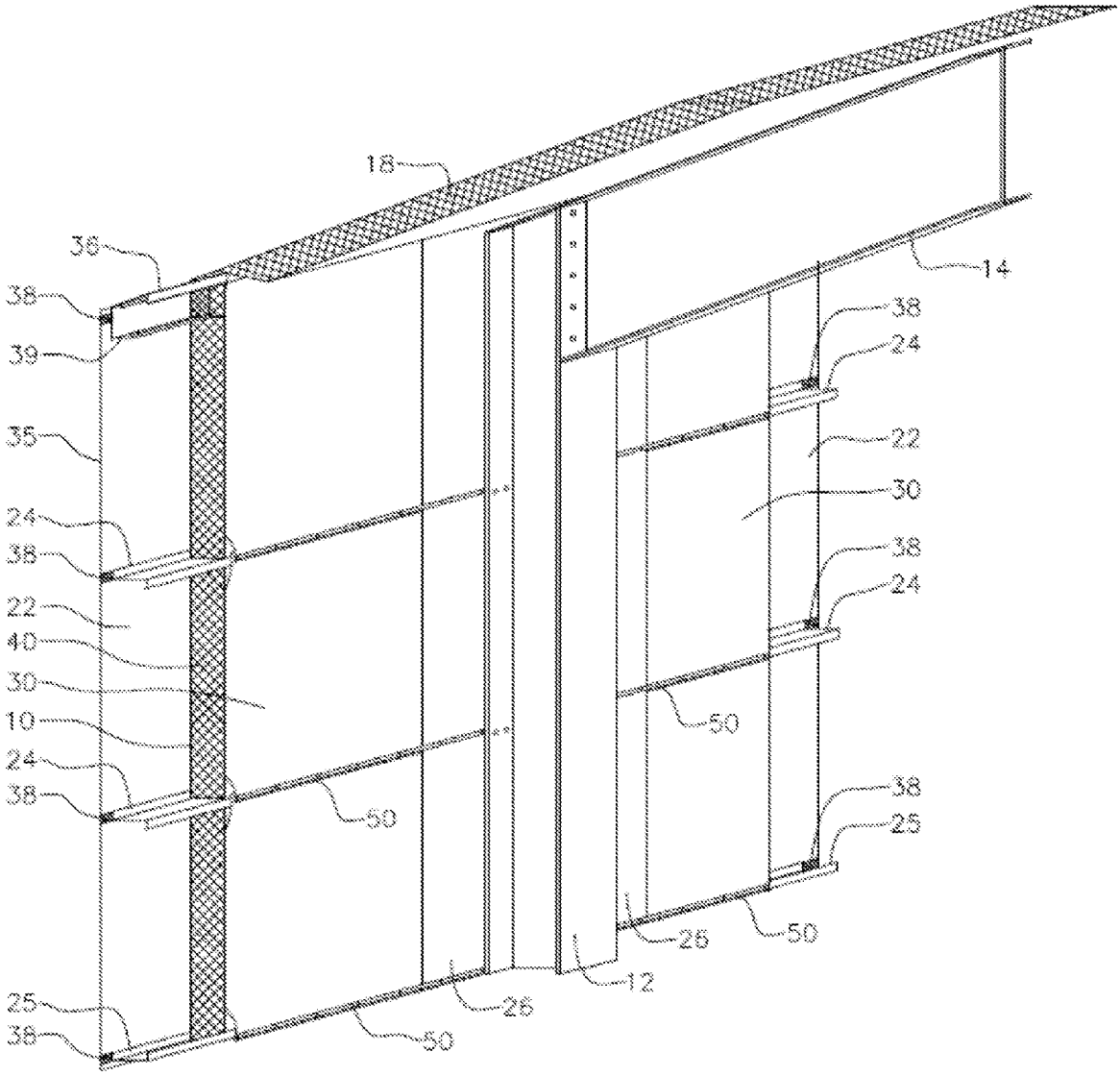
FIG. 2 is a side perspective view of a side wall and roof section of the insulation system of the present invention, showing interior faced blanket insulation extending horizontally within the depth of the wall girts.

The building insulation system of this invention is shown generally at 10 in FIG. 2 with exemplary and like members of a metal building framework being labeled with the same reference numerals as shown in FIG. 1. The invention has optimal application in a by-pass wall girt design. The main vertical support columns 12 (both exterior (i.e. perimeter) and interior support columns) are installed similar to the prior art described above. The perimeter structural support columns include wall columns 12*a* and corner columns 12*b*. Structural roof members 14 are then installed, tying the columns 12 together. Roof purlins 16 (shown as preferred Z-purlins in other figures) are installed normal to and above the structural roof members 14. The main roof support framing members are tied together and bracing (not shown) is installed in the walls and roof, stabilizing the building framework system. Preferably, the wall cladding 22 is installed before the roof insulation 18 and the exterior metal roof cladding 20. The structural support columns 12 (including 12*a*, 12*b*) and the structural roof members 14 are shown as steel I-beams.

Figure 3:
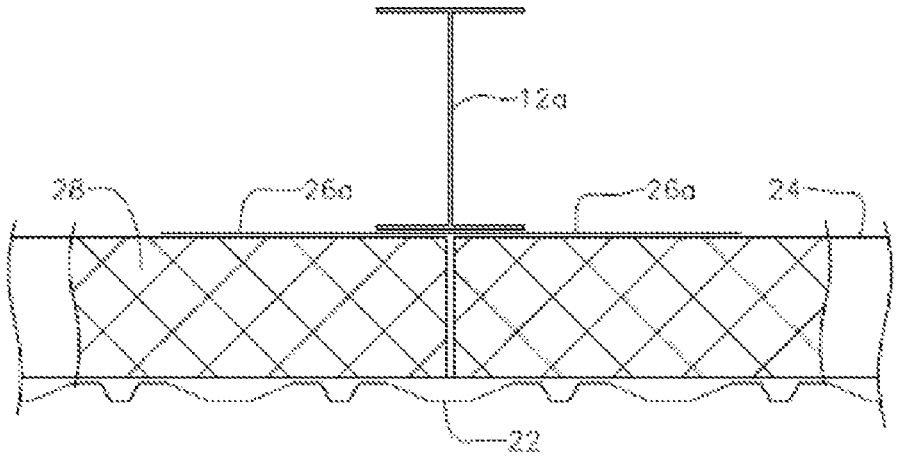
FIG. 3 is a schematic sectional view taken horizontally above a wall girt showing relative placement of the vapor barrier extension of this invention on the exterior face of the structural column and fastened to the interior facing of the blanket insulation.
Figure 4:
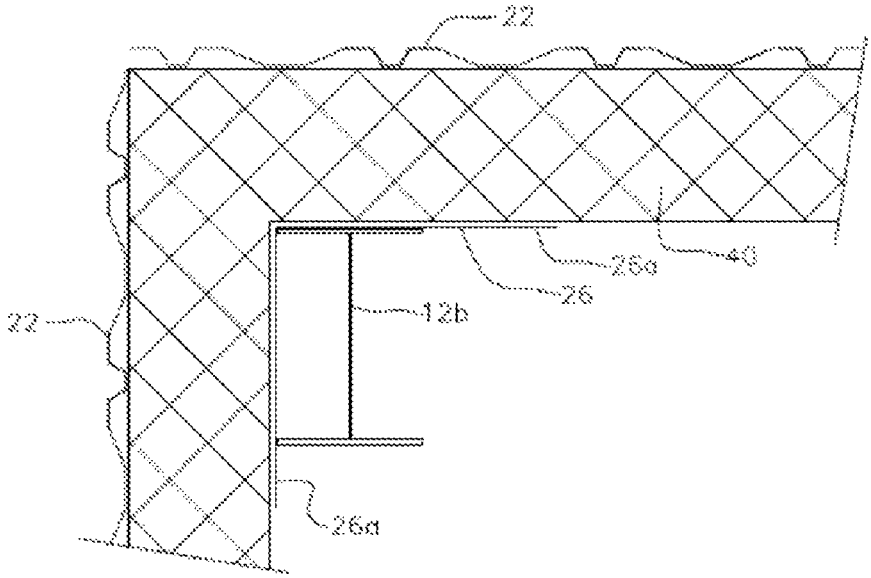
FIG. 4 is a schematic sectional view taken at a building corner column to show placement of the vapor barrier extension on the exterior faces around the corner column and fastened to the interior facing of the blanket insulation.

In the system and method of the present invention, prior to the installation of the perimeter horizontal by-pass wall girts 24, the base C-channel 25 and the eave purlin 39, a vapor barrier extension 26 is connected to the exterior face of the exterior wall columns 12*a* (see FIGS. 3, 5) and to the exterior faces of the corner columns 12*b* (see FIG. 4). The vapor barrier extensions 26 extend horizontally in both directions beyond the side edges of the columns 12*a*, 12*b*, providing lap extensions 26*a* of the vapor barrier extension material to allow for fastening to the later to be installed wall insulation 28. The vapor barrier extension 26 is formed from suitable vapor barrier materials as known in the art, such as reinforced polyethylene sheeting or foil-faced polyethylene sheeting. As described below, these vapor barrier extensions 26 are later sealed to the vapor barrier or to the interior facing 30 of the wall insulation 28. For this purpose, butyl or double sided tape may be used, or the vapor barrier extensions 26 can be manufactured with adhesive and peel paper along their side edges.

Figure 5:
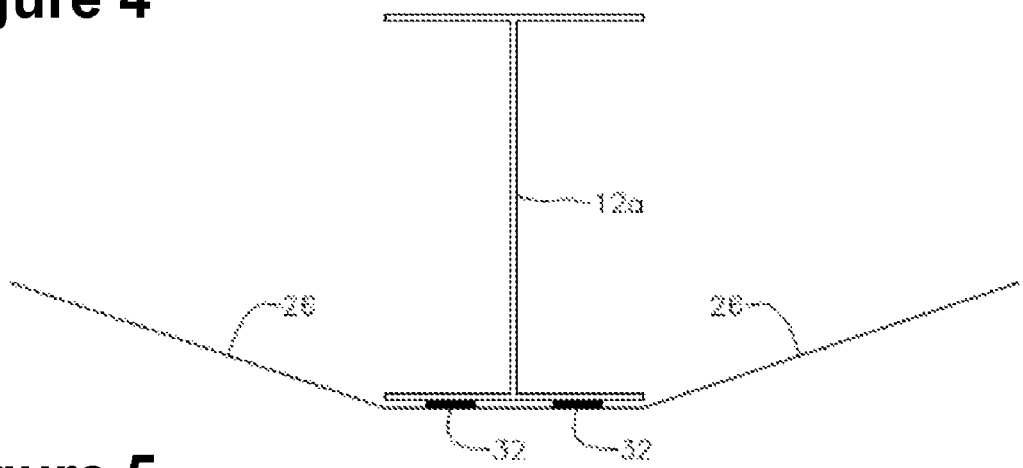
FIG. 5 is a schematic sectional view taken horizontally through a building structural column to show initial placement of the vapor barrier extension prior to installation of the wall girts.

The vapor barrier extension 26 is generally, but not necessarily, made of the same material as the laminated facing material used in the vapor barrier facing 30 of integrally faced/laminated vapor barrier blanket insulation 40 yet to be installed. As shown in FIG. 5, the vapor barrier extension 26 is connected to the exterior column face, for example using butyl or double-sided tapes 32 (or alternatively acoustical sealant or mechanical fastening devices). Alternatively, the vapor barrier extension 26 may be manufactured with adhesive covered with peel paper in their mid sections.

The horizontal wall girts 24 are then installed exterior to the vapor barrier extension 26, and are mechanically attached to the exterior wall and corner columns 12*a*, 12*b*, as known in the art, but with the fastening bolts (not shown) penetrating the added vapor barrier extension 26.

While the method of this invention may at this point utilize other known insulation systems with separate or laminated vapor barriers or mesh, an insulation system as described below, with integrally faced/laminated vapor barrier blanket insulation 40 formed with top and bottom sealing flaps 44, 46, is most preferred for the wall insulation 28. If known insulation techniques are used (not shown), the vapor barrier extensions 26 are sealed (ex. tape or adhesive) to the vapor barrier or mesh of the wall insulation once the wall insulation 28 is in place. Blanket insulation is then installed horizontally from the building interior above and below the wall girts. Adjacent blanket insulation sections above and below the wall girts can be taped together over the wall girts to form horizontal seals. The blanket insulation may also be sealed by tape or adhesive to base C-channels 25 and eave purlins 39 if present.

Figure 6:
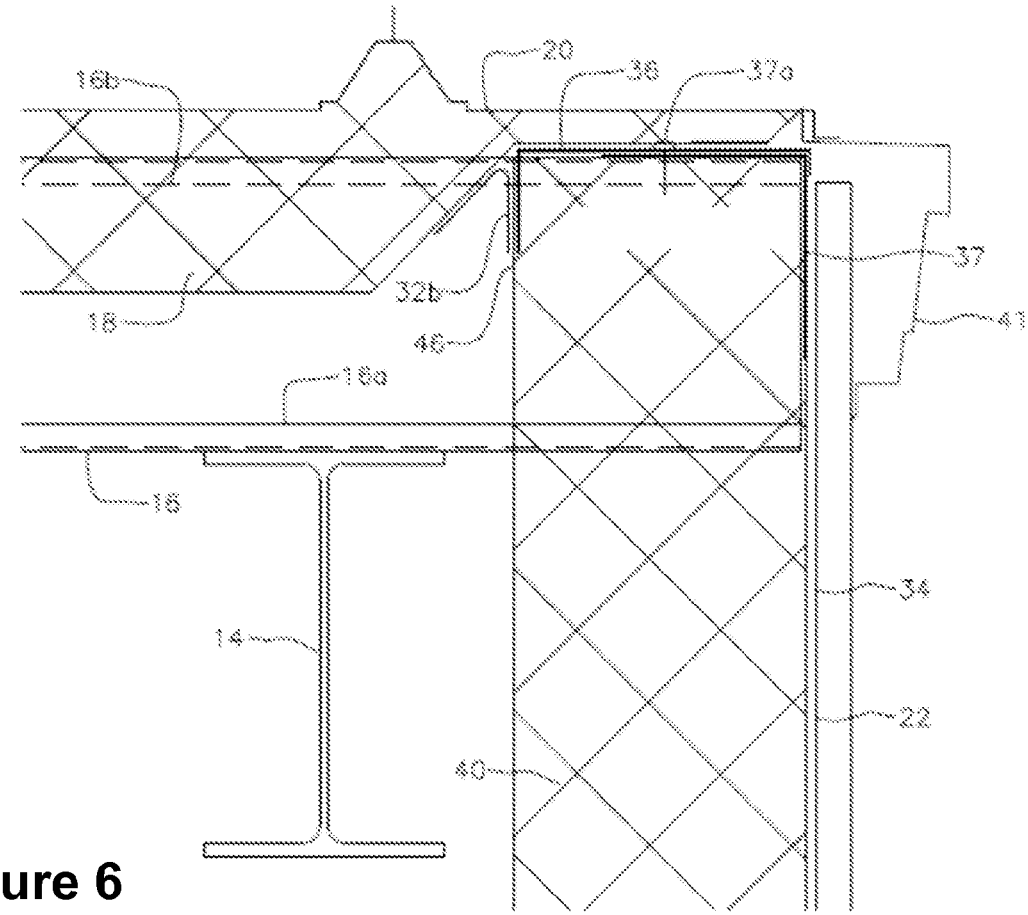
FIG. 6 is schematic sectional view taken vertically at an end wall intersection with the roof to show placement of the C-section channel members with the roof purlins for attaching to the blanket insulation.
Figure 6A:
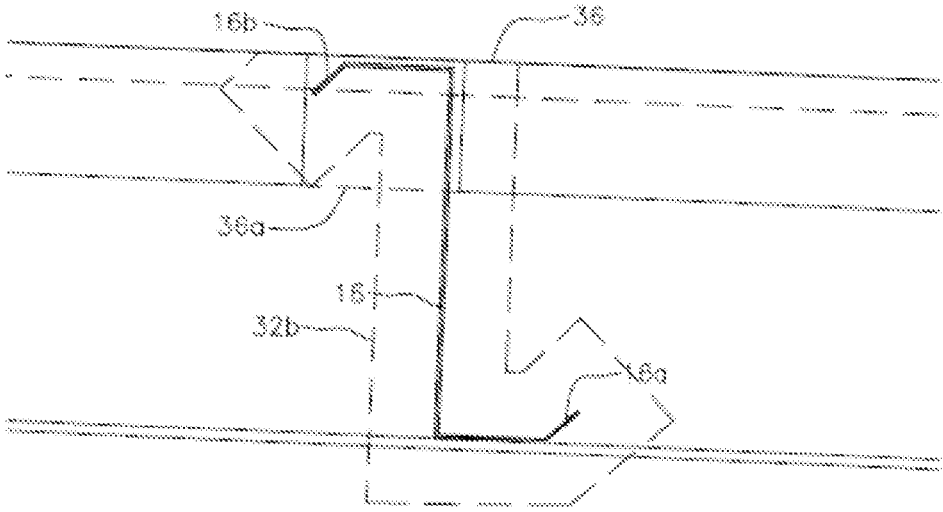
FIG. 6A is a schematic sectional view taken through a roof purlin of FIG. 6, showing the C-section channel member notching at the roof purlin.

As seen in FIG. 6, on building end walls 34, a gauge metal C-section channel member 36 is preferably installed above the steel building sheeting angle 37 and over the terminal ends of the roof purlins 16. These C-section channel members 36 assist in sealing the insulation at the top of the wall, at the junction of the end wall 34 and the roof. The sheeting angle 37 forms part of the building framework at the top of the end walls 34, for fastening of wall cladding 22 and rake trim elements 41. The C-section channel members 36 are notched at each roof purlin 16 (up and down flanges 16*a*, 16*b* of Z-shaped purlins 16 are shown in dotted outline in FIG. 6, and notch 36*a* is shown in down leg of C-section channel member 26 in FIG. 6A) to accommodate the roof purlins 16. The C-section channel members 36 are fastened to the sheeting angle 37 with mechanical self drilling screw fasteners 37*a*, or alternate mechanical fasteners. The C-section channel members 36 create a solid termination location at the roof for attaching the integrally faced/laminated vapor barrier insulation 40 yet to be installed. Sealing tape 32*b* is installed around roof purlins 16 or similar wall penetrations to increase insulation effectiveness, as shown in FIGS. 6 and 6A.

Figure 7:
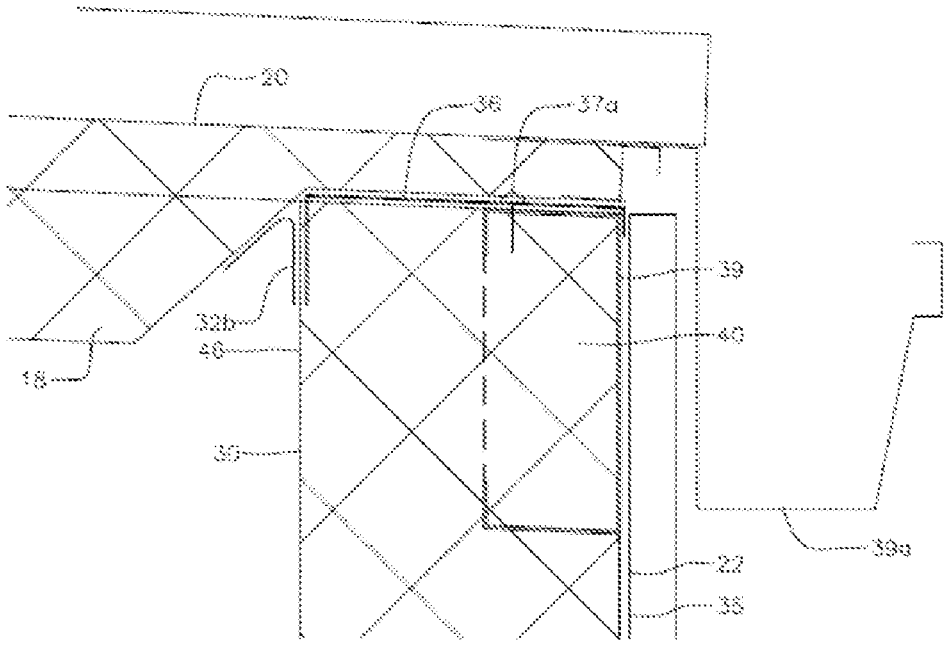
FIG. 7 is a schematic sectional view taken vertically at a side wall intersection with the roof to show placement of the C-section channel members relative to the eave purlins for attaching the blanket insulation.

As shown in FIG. 7, a gauge metal C-section channel member 36 is also preferably installed at the junction of the roof and the building side walls 35, in order to attach the blanket insulation 40, yet to be installed. At the side wall 35, the C-section channel member 36 is fastened over the eave purlin 39 (part of building framework for fastening of wall cladding 22 and building gutters 39*a*). Mechanical fasteners such as self drilling screw fasteners 37*a* may be used to fasten the C-channel members 36.

Figure 8:
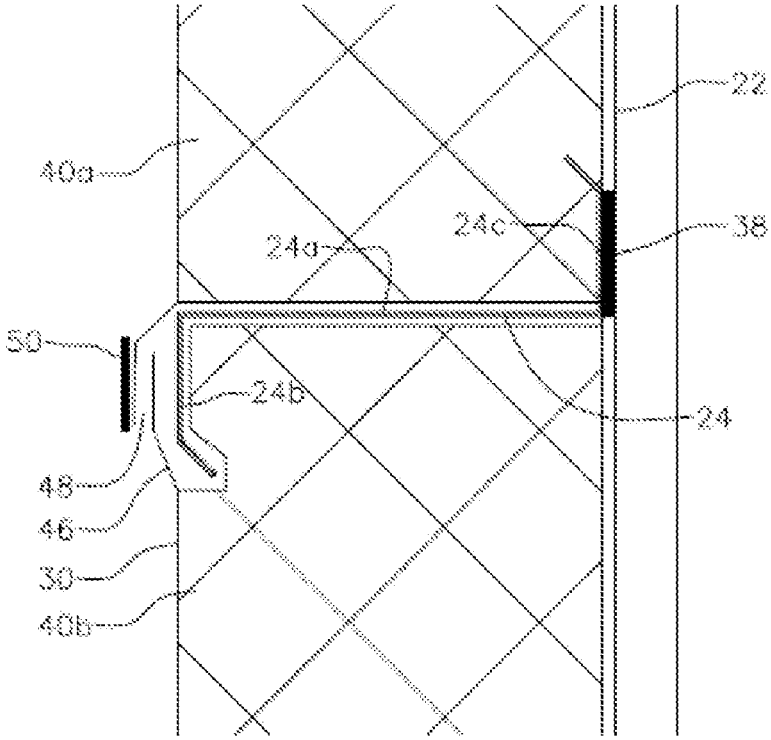
FIG. 8 is a schematic sectional view taken vertically through a wall girt to show the addition of a thermal break element on the exterior face of the wall girt, and to show the overlapping thermal lap seal for the adjacent blanket insulation at the wall girt.

The horizontal wall girts 24 are shown in FIG. 8 to include a horizontal channel portion 24*a*, interior downward flange 24*b* and exterior upward flange 24*c*. Alternate wall girts are known, and may be used, but these generally Z-shaped channel members are commonly used in the industry. Preferably, a thermal break 38 is next applied to the exterior flange 24*c* of the wall girts 24 (exterior vertical face of the wall girt), in order to increase thermal effectiveness. These thermal breaks 38 are also preferably installed at the exterior face of the base channel 25 and eave purlin 39 (see FIG. 2). The material for the thermal break 38, may be wood, plywood strips, rigid or semi-rigid insulation, self adhesive or standard foam gaskets or neoprene material, with a self adhesive neoprene or closed cell material being preferred for its insulating value. The thermal break 38 can be omitted if maximum thermal efficiencies are not needed.

The wall girts 24 and thermal break 38 are then covered with vertical metal wall cladding 22 or alternative exterior cladding systems as known in the art. The fasteners for the wall cladding penetrate the cladding 22, the thermal break 38, and the wall girt 24, but do not generally penetrate the wall insulation 28, yet to be installed.

Figure 9:
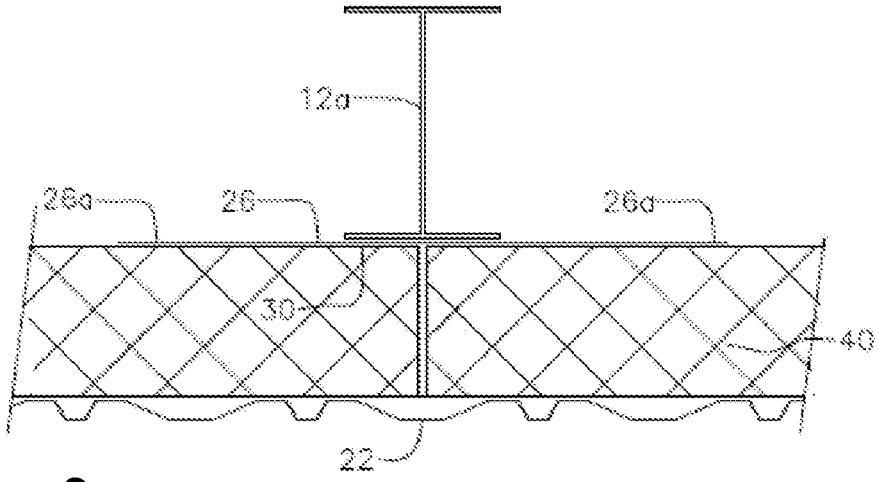
FIG. 9 is a schematic sectional view taken horizontally through a side wall at a building structural column to show the fill void between abutting insulation, if needed.
Figure 10:
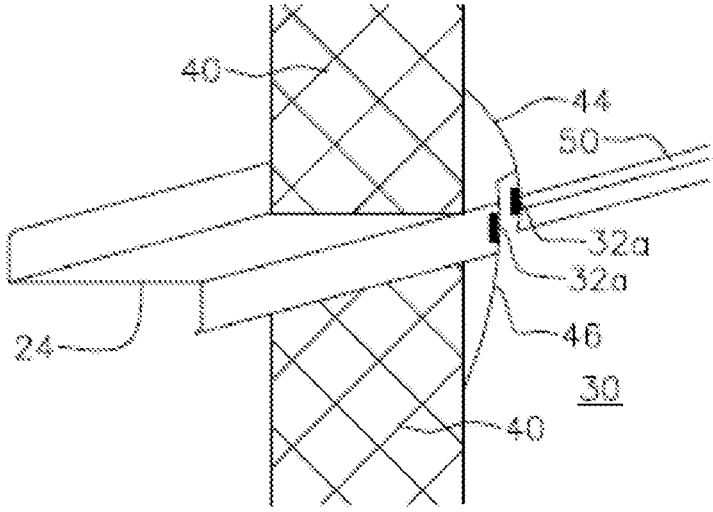
FIG. 10 is a schematic perspective view showing the area above and below a wall girt to illustrate the overlapping thermal lap seal for the adjacent blanket insulation at the interior face of the wall girt.

Upon the completion of the exterior cladding 22, integrally faced/laminated vapor barrier blanket insulation 40 (pre-ordered, cut to fit in width, from girt to girt or site modified as required) is applied from the building interior. As shown in FIGS. 8, 9 and 10, the blanket insulation 40 is installed horizontally to preferably completely fill the depth of the wall girt cavity (depth of channel portion 24*a* plus any gap to the cladding 22). The rolls of blanket insulation 40 are ordered in length equal or multiple to the bay spacing (spacing between columns 12*a*) at a minimum of one bay to conceal the laps behind the column vapor barrier extensions 26. As shown in FIG. 7, the blanket insulation 40 is cut and fitted to completely fill voids of the eave purlins 39. As shown in FIG. 9, the adjacent edges of the blanket insulation typically meet behind a column 12, without gaps, for insulative effectiveness.

Alternatively, the blanket insulation can be installed in multiple layers which combine to fill the full depth of the wall girt 24. In this embodiment (not shown), a first layer of insulation, which need not be laminated to a facing, and which has a thickness less than the full depth of the girt cavity, for example two thirds the depth, is installed horizontally from the interior of the building between the wall girts. The first layer may be held in place by adhesive applied by spray or hand to the back of the exterior cladding 22. Alternatively, mechanical insulation hangers might be applied to the wall girts 24 to hold the insulation in place. The second layer (which is the innermost layer in this example) is then installed as shown in the Figures, with the innermost layer taking the form of the integrally faced/laminated vapor barrier insulation 40, and having a thickness to fill the girt cavity when combined with the first layer. As above, the innermost layer is installed with the interior facing 30 facing the interior of the building.

In a preferred embodiment, the integrally faced/laminated vapor barrier insulation 40 is formed to have facing flaps 44, 46 of the interior facing 30 along both of the side edges of the roll of blanket insulation 40. The facing flaps 44, 46 are sections of the interior facing 30 which are not adhered or not laminated to the insulation material. These facing flaps 44, 46 assist in sealing over the wall girts 24, and in sealing to the base channels 25, eave purlins 39 and C-channels 36. In an exemplary embodiment, the side edge of the roll of insulation 40 which forms the bottom edge once installed is formed with approximately 3 inches of interior facing 30 extending beyond the edge of the insulation 40 to form the bottom facing flap 44. The size of the bottom facing flap 44 may vary but will generally be sufficient to cover the down flange 24*b* of the wall girt 24. A range of 1 to 6 inches may be used. On the other side of the roll of insulation, the interior facing 30 is not adhered or not laminated to the insulation material for about 3 inches or formed as a flap extending beyond the edge of the insulation (a range of 1 to 6 inches may be used) to form the top facing flap 46 once installed. As best viewed in FIGS. 8 and 10, these flaps 44, 46 are overlapped to create a horizontal lap seal 48, connecting together upper and lower adjacent blankets of insulation 40*a*, 40*b* at the building interior directly over the wall girt 24.

These lap seals 48 can be sealed for examples using a butyl or double-sided tape 32*a* (see FIG. 10). Alternatively, the insulation blanket 40 can be manufactured to include an adhesive or tape (for example with a paper peel), preferably on the insulation side of the facing flap 44 or 46, on one side of each roll. The butyl or double-sided tapes can be factory or site applied based on customer preference. The installer can work from the top down or bottom up, left to right or right to left, assuming consistency of choice, sealing the flaps 44, 46 together. As seen in FIGS. 6 and 7, at the roof, the top flaps 46 of the blanket insulation 40 are similarly sealed to the C-section channels 36, applying additional butyl tape 32*b*, if needed. As shown in FIG. 2, at the base, the bottom flaps 44 are sealed to the base channel 25.

Figure 11:
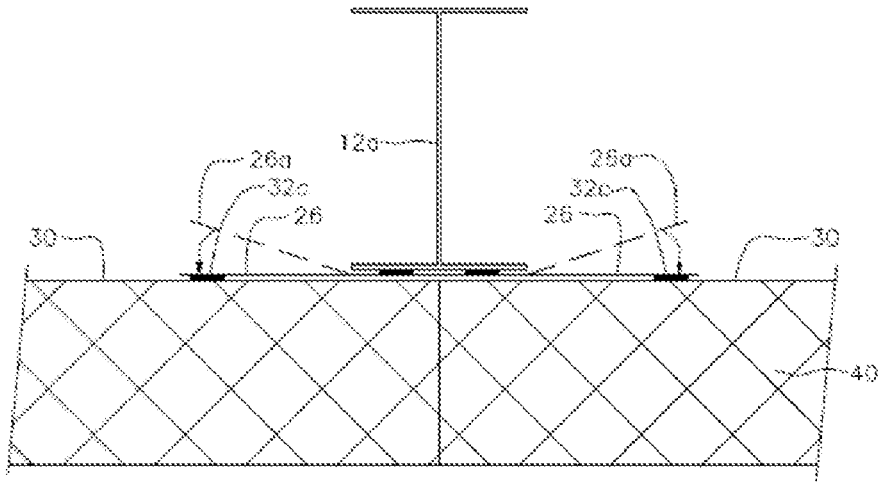
FIG. 11 is a schematic sectional view taken horizontally at a building structural column to show attachment of the lap extensions of the vapor barrier extension to the blanket insulation.

As shown in FIG. 11, the lap extensions 26*a* of the vapor barrier extension 26 behind the columns 12*a* are then sealed to the facing 30 of the blanket insulation 40, using, for example, high bond butyl or double-sided tape 32*c* to the horizontally installed integrally faced/laminated vapor barrier blanket insulation 40 adjacent to the vertical wall column flanges 12*a*. Butyl or double-sided tapes 32*c* is placed between the vapor barrier extension 26 and the integrally faced/laminated vapor barrier 40 and the layers are pressed together to seal to the interior facing 30. The vapor barrier extensions 26 are similarly sealed to the blanket insulation 40 at the corner columns 12*b*.

In alternate embodiments where blanket insulation 40 is used without the specialized facing flaps 44, 46, the thermal lap seals 48 might be formed by taping over the wall girts to the vapor barriers located above and below.

Figure 12:
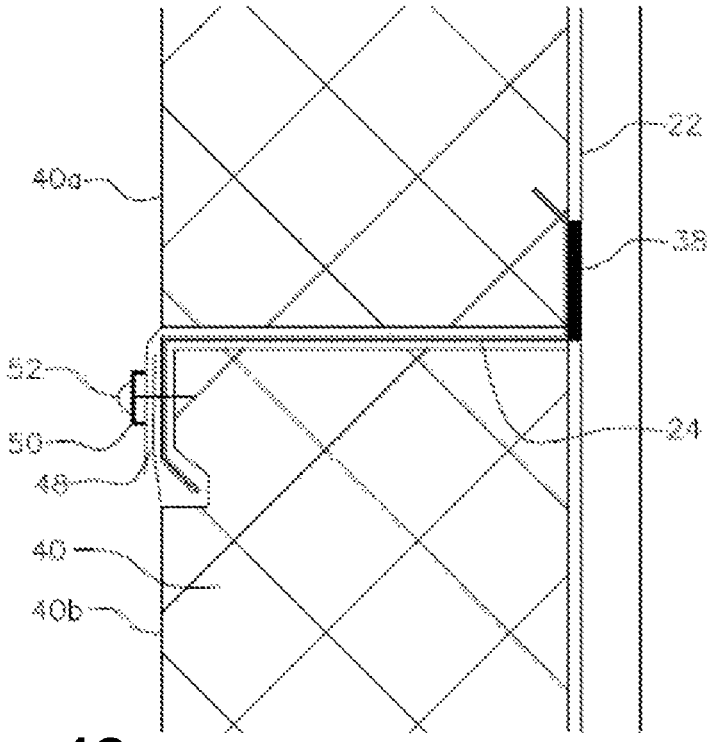
FIG. 12 is a schematic sectional view taken vertically through a wall girt to show optional use of mechanical fasteners at the overlapping thermal lap seal at the wall girt.

As shown in FIG. 12 a pressure strip of gauge metal 50 (example gauge metal C or steel stud stiffener channel pressure strip) complete with mechanical fasteners 52 (such as panhead self drilling screws) is preferably installed over the horizontal lap seals 48 of the facing flaps 44, 46.

Figure 13:
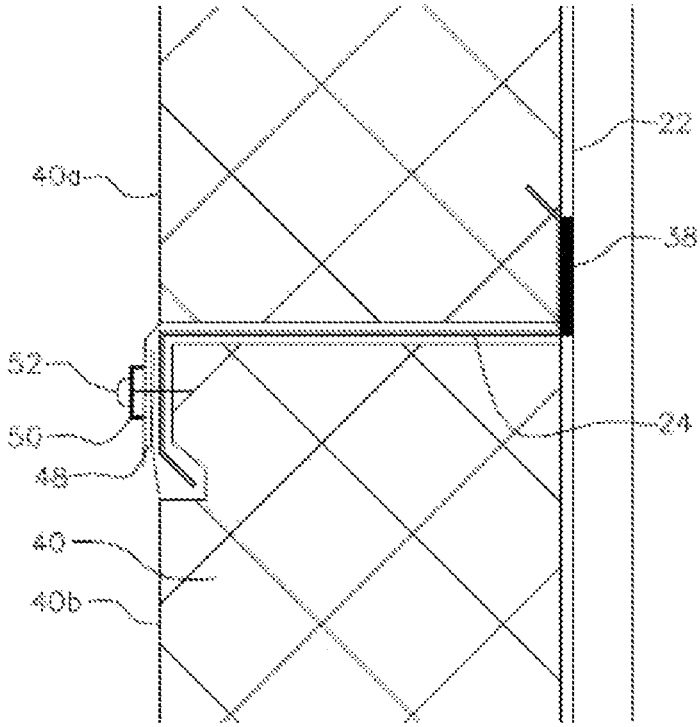
FIG. 13 is a schematic sectional view of the same area as FIG. 6, but showing the alternate use of sprayed insulation.

Alternately, spray foam or foam-in-place insulations might be used. These may contain chemical properties or top coats which both insulate to the desired value and seal the wall and roof insulations 28, 18 together. As shown in FIG. 13, spray foam 54 might be installed. As described above, the integrally faced/laminated vapor barrier blanket insulation 40 is installed in the wall cavity, but only to the elevation equal to the underside of the roof purlins 16. In preparing the insulation/vapor barrier 40 for this area the material of the facing 30 is cut to form a roof flap 56 over the top of the insulation folded back far enough to tie the wall vapor barrier 40 to the spray foam insulation product 54. Spray foam 54 is installed into the cavity to insulate and seal the wall to the roof and purlin penetrations. This method can be incorporated into end walls 34 or side walls 35 or both if desired.

It will be appreciated that the insulation system of this invention can achieve increased insulative effectiveness compared to the prior art systems described above, since the insulation 40 can extend the full depth of the wall girts 24. For a typical 8 inch wall girt, this might achieve an R28 insulative value, while a 10 inch wall girt might achieve an R32 insulative value. The latter represents about a 300 percent increase in efficiency compared to the overall performance of a prior art insulation system. This in turn reduces occupancy costs for the building. As well, since the insulation system can be installed from the interior, and with simplicity, overall building costs should drop.

All references mentioned in this specification are indicative of the level of skill in the art of this invention. All references are herein incorporated by reference in their entirety to the same extent as if each reference was specifically and individually indicated to be incorporated by reference. However, if any inconsistency arises between a cited reference and the present disclosure, the present disclosure takes precedence. Some references provided herein are incorporated by reference herein to provide details concerning the state of the art prior to the filing of this application, other references may be cited to provide additional or alternative device elements, additional or alternative materials, additional or alternative methods of analysis or application of the invention.

The terms and expressions used are, unless otherwise defined herein, used as terms of description and not limitation. There is no intention, in using such terms and expressions, of excluding equivalents of the features illustrated and described, it being recognized that the scope of the invention is defined and limited only by the claims which follow. Although the description herein contains many specifics, these should not be construed as limiting the scope of the invention, but as merely providing illustrations of some of the embodiments of the invention.

One of ordinary skill in the art will appreciate that elements and materials other than those specifically exemplified can be employed in the practice of the invention without resort to undue experimentation. All art-known functional equivalents, of any such elements and materials are intended to be included in this invention. The invention illustratively described herein suitably may be practiced in the absence of any element or elements, limitation or limitations which is not specifically disclosed herein.

I claim:

1. A method of insulating a building framework for a bypass wall girt metal building type, wherein the building framework includes vertical structural wall columns, corner columns and roof structural members to support side walls, end walls and a roof, the wall and corner columns having exterior faces, the building framework further including parallel spaced horizontal wall girts connected to the exterior faces of the structural and corner columns, and parallel spaced roof purlins connected above and normal to the roof structural members, the method of insulating the building framework comprising:

prior to connecting the wall girts, connecting to each exterior face of the wall and corner columns, a vapor barrier extension member formed of vapor barrier material, the vapor barrier extension member forming side edges and having lap extensions which extend horizontally in both directions beyond the exterior face or faces of the wall and corner columns to the side edges of the vapor barrier extension member;

connecting the wall girts to the exterior faces of the wall and corner columns;

installing insulation in one or more layers between the wall girts, the innermost layer of insulation being provided with an interior facing;

fastening the lap extensions of the vapor barrier extensions along the side edges to the interior facing of the insulation on either side of the wall and corner columns.

2. The method of claim 1, which further comprises, prior to installing the insulation, installing exterior cladding exterior to the wall girts to close in the building framework and to form the side walls and end walls.

3. The method of claim 2, wherein the innermost layer of insulation comprises a blanket of insulation material laminated to the interior facing, and wherein the one or more layers of insulation are installed horizontally above and below the wall girts from the interior of the building.

4. The method of claim 3, wherein the method further comprises, after installing the insulation between the wall girts with adjacent insulation sections positioned above and below the wall girts, sealing together adjacent insulation sections with tape or adhesive to form horizontal seals which overlie the wall girts.

5. The method of claim 4, wherein the building framework includes base channels, sheeting angles, and eave purlins, and wherein the method further comprises, prior to closing in the building framework with exterior cladding, installing channel members over the eave purlins at the junction of the roof and side walls and over the sheeting angles at the junction of the roof and end walls, and sealing the insulation to the channel members and to the base channels.

6. The method of claim 5, wherein the wall girts each have an interior face and an exterior face and wherein the method further comprises, prior to closing in the building framework with exterior cladding, attaching a thermal break on the exterior face of the wall girts.

7. The method of claim 3, wherein the innermost layer of insulation is formed with a facing flap along both side edges, the facing flaps being sections of the interior facing which are not laminated to the insulation material, and wherein the method further comprises, after installing the insulation between the wall girts with adjacent insulation sections positioned above and below the wall girts, forming horizontal lap seals at each wall girt by overlapping and sealing together the facing flaps of the adjacent insulation sections which overlie the wall girts.

8. The method of claim 7, wherein the building framework includes base channels, sheeting angles and eave purlins, and wherein the method further comprises, prior to closing in the building framework with exterior cladding, installing channel members over the eave purlins at the junction of the roof and side walls and over the sheeting angles at the junction of the roof and end walls, and sealing the facing flaps of the insulation to the channel members and to the base channels.

9. The method of claim 8, wherein the wall girts each have an interior face and an exterior face and wherein the method further comprises, prior to closing in the building framework with exterior cladding, attaching a thermal break on the exterior face of the wall girts.

10. The method of claim 9, wherein the one or more layers of insulation provide a depth of insulation which extends from the exterior cladding to the interior face of the wall girts.

11. The method of claim 10, wherein tape or adhesive is used to connect the vapor barrier extensions to the wall and corner columns, wherein the vapor barrier lap extensions are fastened to the interior facing of the insulation with tape or adhesive, and wherein the facing flaps are sealed with tape or adhesive to form the horizontal lap seals and to seal to the base channels and channel members.

12. The method of claim 11, wherein a pressure strip of gauge metal with mechanical fasteners is installed over the horizontal lap seals.

13. The method of claim 3, wherein the wall girts each have an interior face and an exterior face and wherein the method further comprises, prior to closing in the building framework with exterior cladding, attaching a thermal break on the exterior face of the wall girts.

* * * * *